US010748548B2

(12) United States Patent
Yang et al.

(10) Patent No.: US 10,748,548 B2
(45) Date of Patent: Aug. 18, 2020

(54) VOICE PROCESSING METHOD, VOICE COMMUNICATION DEVICE AND COMPUTER PROGRAM PRODUCT THEREOF

(71) Applicant: Unlimiter MFA Co., Ltd., Eden Island (SC)

(72) Inventors: Kuo-Ping Yang, Taipei (TW); Ho-Hsin Liao, Taipei (TW); Kuan-Li Chao, Taipei (TW); Neo Bob Chih-Yung Young, Taipei (TW); Jian-Ying Li, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 138 days.

(21) Appl. No.: 15/593,374

(22) Filed: May 12, 2017

(65) Prior Publication Data

US 2018/0151190 A1 May 31, 2018

(30) Foreign Application Priority Data

Nov. 25, 2016 (TW) ..... 105138949 A

(51) Int. Cl.
*G10L 21/02* (2013.01)
*G10L 21/007* (2013.01)

(52) U.S. Cl.
CPC ..... *G10L 21/02* (2013.01); *G10L 21/007* (2013.01)

(58) Field of Classification Search
CPC ..... G10L 21/07
USPC ..... 704/206
See application file for complete search history.

(56) References Cited

U.S. PATENT DOCUMENTS 5,519,774 A * 5/1996 Battista ..... H04M 1/573 379/282
5,543,939 A * 8/1996 Harvey ..... H04N 7/12 348/14.01
7,346,513 B2 * 3/2008 Azuma ..... G06F 3/162 704/201
8,108,217 B2 * 1/2012 Yoo ..... G10L 21/0208 704/226
2005/0195990 A1 * 9/2005 Kondo ..... G10L 21/0272 381/92
2006/0241938 A1 * 10/2006 Hetherington ..... G10L 21/02 704/208
2011/0200048 A1 * 8/2011 Thi ..... H04B 3/23 370/392
2014/0358530 A1 * 12/2014 Young ..... G10L 21/0364 704/207
2015/0201057 A1 * 7/2015 Chao ..... H04M 1/6008 455/569.1
2018/0226087 A1 * 8/2018 Tu ..... G10L 25/93

* cited by examiner

*Primary Examiner* — Huyen X Vo
*Assistant Examiner* — Timothy Nguyen
(74) *Attorney, Agent, or Firm* — Bacon & Thomas, PLLC

(57) ABSTRACT

A voice processing method, a voice communication device, and a computer program product thereof are disclosed. The method comprises the steps of: receiving a transmitting voice signal from a receiver end communication device; determining a frequency range of the transmitting voice signal; receiving an original voice signal from a first user; processing the original voice signal to a processed voice signal, wherein the processed voice signal is generated based on the frequency range of the transmitting voice signal; and outputting the processed voice signal to the receiver end communication device.

15 Claims, 2 Drawing Sheets

VOICE PROCESSING METHOD, VOICE COMMUNICATION DEVICE AND COMPUTER PROGRAM PRODUCT THEREOF

BACKGROUND OF THE INVENTION

1. Field of the Invention

The present invention relates to a voice processing method and its voice communication device; more particularly, the present invention relates to a voice processing method and its voice communication device capable of automatically performing a frequency reduction process.

2. Description of the Related Art

In modern times, it is very common to use a mobile phone or communication software to carry on a conversation. However, due to frequency range limitation, such type of communication network would filter out signals over a specific frequency. Therefore, transmission signals received by a communication device are usually adjusted signals with specific signals being filtered out. For example, local calls would filter out frequencies over 4000 Hz; at this time, neither hearing impaired person nor normal people can hear sounds over 4000 Hz via the communication device. Because a lot of consonants belong to frequencies over 4000 Hz, general users cannot recognize correct conversations.

Therefore, there is a need to provide a voice processing method and its voice communication device to mitigate and/or obviate the aforementioned problems.

SUMMARY OF THE INVENTION

It is an object of the present invention to provide a voice communication device characterized in automatically performing a frequency reduction process.

It is another object of the present invention to provide a voice processing method applied in the abovementioned voice communication device.

To achieve the abovementioned objects, the voice communication device of the present invention is used by a first user to communicate with a receiver end communication device used by a second user. The voice communication device comprises an audio transmission module, an analysis module and a processor. The audio transmission module is used for receiving a transmitting voice signal from the receiver end communication device. The analysis module is electrically connected to the audio transmission module, and is used for determining a frequency range of the transmitting voice signal. The processor is electrically connected to the analysis module. When receiving an original voice signal inputted from the first user, the processor processes the original voice signal to a processed voice signal, wherein the processed voice signal is generated based on the frequency range of the transmitting voice signal, so as to output the processed voice signal to the receiver end communication device via the audio transmission module.

The voice processing method of the present invention comprises the following steps: receiving a transmitting voice signal from the receiver end communication device; determining a frequency range of the transmitting voice signal; receiving an original voice signal from the first user; processing the original voice signal to a processed voice signal, wherein the processed voice signal is generated based on the frequency range of the transmitting voice signal; and outputting the processed voice signal to the receiver end communication device.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
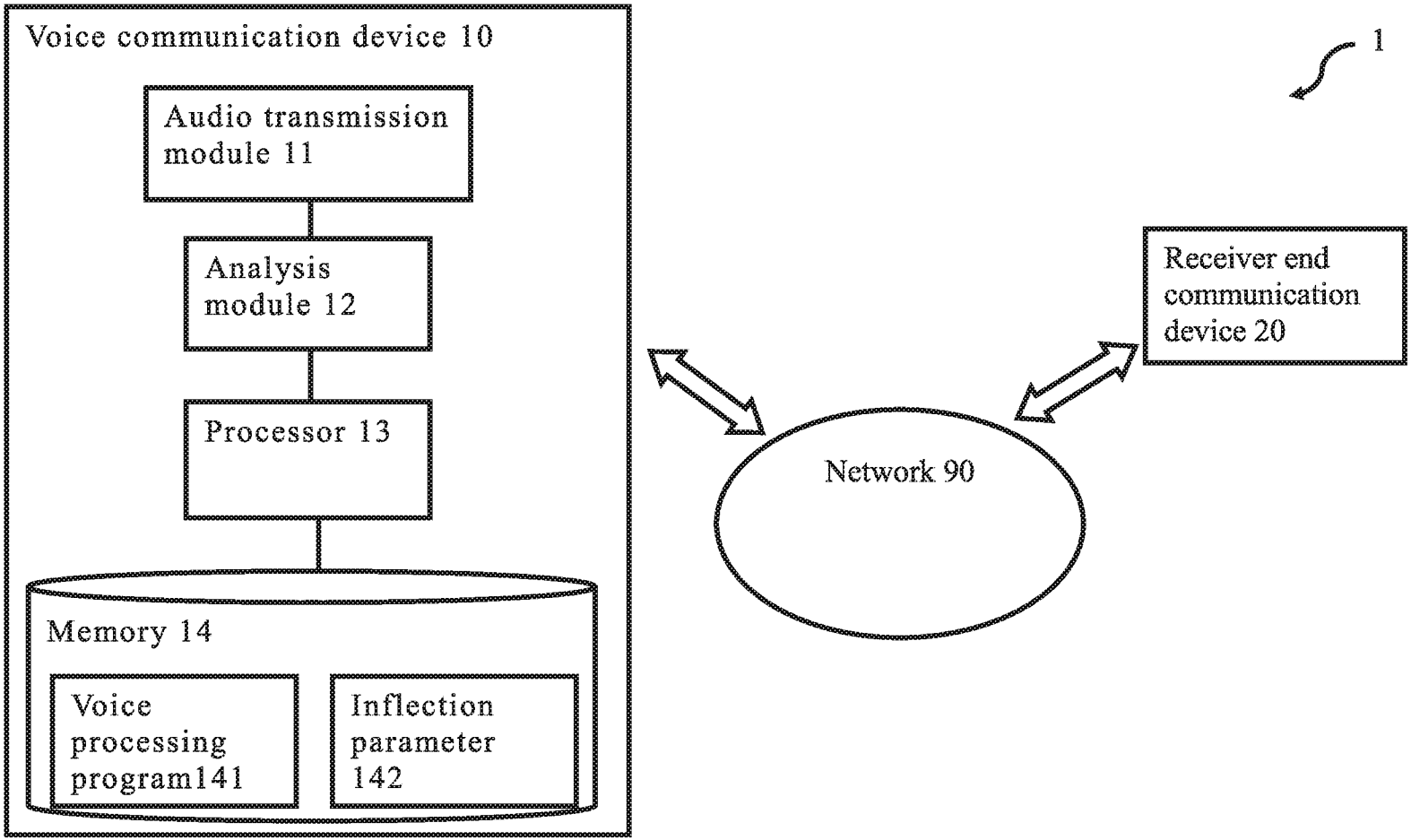
FIG. 1 illustrates a schematic drawing showing a use environment of a voice communication device and a receiver end communication device according to the present invention.

Please refer to FIG. 1, which illustrates a schematic drawing showing a use environment of a voice communication device and a receiver end communication device according to the present invention.

In embodiments of the present invention, a first user can dial a voice communication device 10 to call a second user, and the second user can use a receiver end communication device 20 to answer the call. In the present invention, the voice communication device 10 and the receiver end communication device 20 can be the same type of devices, which means, the device is capable of both dialing a call and answering a call, for example but not limited to, a mobile phone, a smart phone, a computer (Internet telephone), a walkie talkie or a home telephone. The voice communication device 10 and the receiver end communication device 20 is connected via a network 90. The network 90 includes Internet, telecommunication networks, wireless networks (such as 3G, 4G, Wi-Fi), and etc.

The voice communication device 10 comprises an audio transmission module 11, an analysis module 12, a processor 13, and a memory 14. The audio transmission module 11 is used for transmitting and receiving voice signals. In one embodiment of the present invention, after the voice communication device 10 establishes a communication connection with the receiver end communication device 20, the audio transmission module 11 first receives a transmitting voice signal from the receiver end communication device 20. The analysis module 12 is electrically connected to the audio transmission module 11, and is used for determining a frequency range of the transmitting voice signal. Due to frequency range limitation of telecommunications, audio signals over a certain frequency band would be truncated with different phones (such as 4G, 3G or 2G phones) having different frequency bands. Take Skype™ as an example, pure voice communication having frequencies over 8000 Hz would be truncated, and same thing applies to current 4G phone-to-phone communication. As for a traditional 2G or 3G phone communications, even frequencies over 4000 Hz would be truncated. In one embodiment of the present invention, the analysis module 12 would firstly analyze whether there are directly truncated voice frequency bands in the transmitting voice signal. If it is determined that there are directly truncated voice frequency bands in the voice signal, the analysis module 12 would know the transmitting voice signal is being processed, so as to further determine a frequency range of the transmitting voice signal. On the other hand, the analysis module 12 can also determine whether energy values of the transmitting voice signal are all smaller than a specific value; for example, energies of the voice signal over 4000 Hz are all very small, and it can confirm the frequency range of the transmitting signal would not exceed 4000 Hz. However, please note the scope of the present invention is not limited to the above conditions.

The processor 13 is electrically connected to the analysis module 12. When the first user wants to carry on a conversation, the voice communication device 10 would receive an original voice signal inputted by the first user. Then, the processor 13 would process the original voice signal to a processed voice signal based on the frequency range of the transmitting voice signal. If the frequency range of the transmitting voice signal of the receiver end communication device 20 is wide enough, for example, the frequency range is over 8000 Hz, the processor 13 applies a relatively smaller adjustment range to the original voice signal, or, the frequency of the processed voice signal can be the same as that of the original voice signal.

If the frequency range of the transmitting voice signal is relatively small, which means the receiver end communication device 20 is subject to its own voice communication frequency band. Therefore, the processor 13 would perform adjustment to the original voice signal, for example, the processor 13 would perform a frequency reduction process, and then outputs the processed voice signal to the receiver end communication device 20 via the audio transmission module 11. In one embodiment of the present invention, the processor 13 divides the inputted transmitting voice signal into a plurality of voice segments, wherein the time length of each of the voice segments can be between 0.0001~0.1 second. Afterwards, the processor 13 further determines whether each of the voice segments is a high frequency consonant segment. There are many ways for determining a high frequency consonant segment. In one embodiment of the present invention, the processor 13 would determine the voice segment as a high frequency consonant segment if the voice segment satisfies the following conditions: if the energy of the voice segment under 1000 Hz is smaller than 50% of the total energy of the voice segment; and if the energy of the voice segment over 2000 Hz is greater than 30% of the total energy of the voice segment. In an alternative and relatively simpler way, a voice segment is suggested to be determined as a high frequency consonant segment if the energy of the voice segment over 2500 Hz occupies at least 50% of the total energy of the voice segment. Please note the scope of the present invention is not limited to the above description.

The memory 14 can be stored with a voice processing program 141 and an inflection parameter 142 of a user. The processor 13 can perform the frequency reduction process by means of, but not limited to, accessing the voice processing program 141. The frequency reduction process is usually accomplished through frequency compression or frequency shift. The voice processing program 141 would perform the frequency reduction process according to different voice communication frequency bands. Because the high frequency consonant segment has important voice energy in the high frequency section, the voice processing program 141 performs the frequency reduction process to the high frequency energy to avoid direct truncation of voice information over 8000 Hz. Take Skype™ video communication as an example, because information over 4000 Hz would be truncated, the frequency reduction process needs to process the high frequency consonant segment to a range below 4000 Hz. For example, the invention compresses the segment between 6 KHz~12 KHz into the segment between 6 KHz~8 KHz, while the segment between 0 KHz~6 KHz remains unchanged. Or, the invention compresses the segment between 8 KHz~12 KHz into the range between 8 KHz~10 KHz, and then shifts it to the segment between 6 KHz~8 KHz. The above voice communication frequency range is not limited to the frequency range of the receiver end communication device 20; if the voice communication frequency range of the voice communication device 10 itself is not wide enough, the processor 13 would also perform the frequency reduction process by means of accessing the voice processing program 141. Please note that the implementation of performing the frequency reduction process to the high frequency consonant may vary due to different languages and different performances of electronic devices developed by different companies, there is no need for further description because the present invention is not focused on how to perform the frequency reduction process to the high frequency consonant.

The inflection parameter 142 is recorded with hearing information (such as "hardly hearing sounds over 4000 Hz") of the second user (who can be a hearing impaired person, including an elderly with hearing loss), or recorded with information of how to alter the sound to improve the hearing condition based on, for example, an amplification parameter, a hearing parameter (such as a hearing capability parameter of the hearing impaired person) or a frequency change parameter (such as a frequency compression parameter or a frequency shift parameter). For example, the inputted voice signal are already being processed to be under 8000 Hz, however, because it has high frequency consonant voice along with the fact that the hearing impaired person can only hear voice between 0~4 KHz, the invention needs to perform the frequency reduction process to the high frequency consonant section, such that the high frequency consonant section would be processed to be under 4 KHz. Therefore, besides the ordinary process performed according to the voice processing program 141, the processor 13 can also further performs the frequency reduction process by reading the inflection parameter 142. Because it is a well-known technique of controlling inflection output via the inflection parameter 142 (i.e. the technique applied to a hearing aid), there is no need for further description. Please note that the inflection parameter 142 can also be an Audiogram, and thus the processor 13 can utilize a software program to determine how to change the voice according to the Audiogram.

In one embodiment of the present invention, the processor 13 does not perform process to vowels (such as performing process to information under 4 KHz), because the energy of vowels over 4 KHz is not great, it would instead result in poor outputted voice if performing frequency compression or frequency shift to the vowels between 4~8 KHz. Further, the infrastructure of the receiver end communication device 20 can be the same as that of the voice communication 10; therefore there is no need for duplicate component marks in FIG. 1. As a result, after the transmitting voice signal from the receiver end communication device 20 is received by the audio transmission module 11, the analysis module 12 would further analyze whether it needs to perform the process. After being processed by the processor 13, the processed voice signal is generated, wherein the processed voice signal can be determined based on the frequency range of the transmitting voice signal, and can be further outputted to the receiver end communication device 20 via the audio transmission module 11. If the invention does not need to perform the process, the original voice signal would be directly outputted to the receiver end communication device 20 via the audio transmission module 11.

Please note that each of the modules of the voice communication device 10 and the receiver end communication device 20 can be a hardware device, a software program combined with a hardware device, a firmware combined with a hardware device or a combination thereof without limiting the scope of the present invention. For example, the voice communication device 10 can be accomplished by means of utilizing a computer program product. Furthermore, embodiments disclosed herein are only preferred embodiments as examples for describing the present invention, in order to avoid redundant expressions, not all possible variations and combinations are described in details in this specification. However, those skilled in the art would understand the above modules or components are not all necessary parts; or, in order to implement the present invention, other more detailed known modules or components might also be included. It is possible that each module or component can be omitted or modified depending on different requirements; and it is also possible that other modules or components might be disposed between any two modules.

Figure 2:
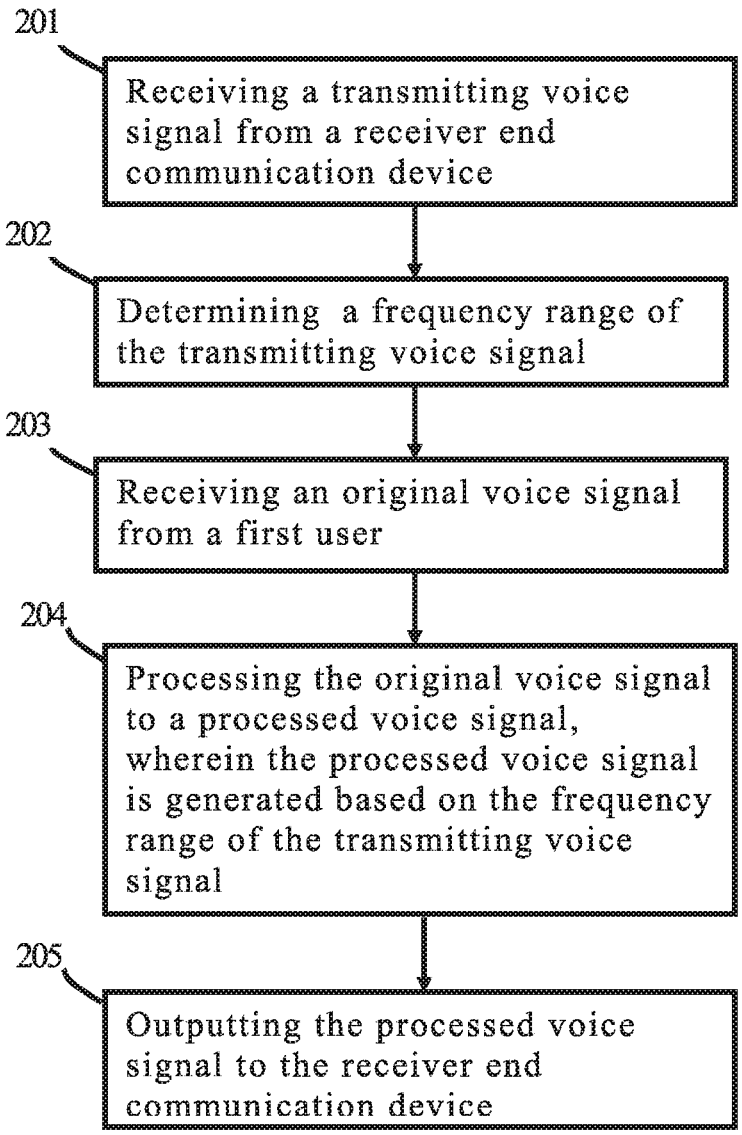
FIG. 2 illustrates a flowchart of a voice processing method according to the present invention.

Then, please refer to FIG. 2, which illustrates a flowchart of a voice processing method according to the present invention. Please note that the abovementioned voice communication device 10 is used as an example to describe the voice processing method of the present invention; however, the scope of the voice processing method of the present invention is not limited to be used in the voice communication device 10.

First, the method performs step 201: receiving a transmitting voice signal from a receiver end communication device.

At first, after the voice communication device 10 establishes a communication connection with the receiver end communication device 20, the audio transmission module 11 first receives a transmitting voice signal from the receiver end communication device 20.

Then, the method performs step 202: determining a frequency range of the transmitting voice signal.

Then, the analysis module 12 is used for determining a frequency range of the transmitting voice signal. For example, the method can utilize the analysis module 12 to analyze whether there are directly truncated voice frequency bands in the transmitting voice signal. If it is determined that there are directly truncated voice frequency bands in the voice signal, the analysis module 12 would confirm that the transmitting voice signal is an adjusted voice signal, so as to further determine the frequency range of the transmitting voice signal. On the other hand, the analysis module 12 can also determine whether energy values of the transmitting voice signal are all smaller than a specific value; for example, energies of the voice signal over 4000 Hz are all smaller than a specific value, and thus the analysis module 12 can also confirm that the transmitting voice signal is the adjusted voice signal. Therefore, if a similar condition is being detected, the analysis module 12 would determine that the transmitting voice signal is an adjusted voice signal. However, please note the scope of the present invention is not limited to the above condition.

Next, the method performs step 203: receiving an original voice signal from a first user.

When the first user wants to carry on a conversation, the voice communication device 10 would receive the original voice signal inputted by the first user.

Then, the method performs step 204: processing the original voice signal to a processed voice signal, wherein the processed voice signal is generated based on the frequency range of the transmitting voice signal.

Then, while receiving the original voice signal inputted by the first user, the processor 13 processes the original voice signal to a processed voice signal based on the frequency range of the transmitting voice signal. If the frequency range of the transmitting voice signal of the receiver end communication device 20 is wide enough, the processor 13 applies a relatively smaller adjustment range to the original voice signal.

If the frequency range of the transmitting voice signal is relatively small, which means the receiver end communication device 20 is subject to its own voice communication frequency band. Therefore, the processor 13 can perform the frequency reduction process by means of accessing the voice processing program 141 stored in the memory 14. The frequency reduction process is usually accomplished through frequency compression or frequency shift. Besides the ordinary process performed according to the voice processing memory 141, the processor 13 can also further performs the frequency reduction process by means of reading the inflection parameter 142 stored in the memory 14 for the second user.

Finally, the method performs step 205: outputting the processed voice signal to the receiver end communication device.

Finally, after being processed by the processor 13, the processed voice signal is generated, wherein the processed voice signal can be determined based on the frequency range of the transmitting voice signal, and can be further outputted to the receiver end communication device 20 via the audio transmission module 11.

Please note that the voice processing method of the present invention is not limited to be executed by following the abovementioned sequence and order. The execution order can be modified as long as the object of the present invention can be achieved. The characteristic of the present invention is to keep important high frequency voice data of high frequency consonants by means of performing a frequency reduction process to the high frequency consonants without being influenced by the fact that information over 8000 Hz or 4000 Hz would be truncated.

As a result, the voice communication device 10 can utilizes the voice returned from the receiver end communication device 20 to determine whether the receiver end communication device 20 is in a communication environment that needs to be adjusted, thereby further achieving better communication effect.

Although the present invention has been explained in relation to its preferred embodiments, it is to be understood that many other possible modifications and variations can be made without departing from the spirit and scope of the invention as hereinafter claimed.

What is claimed is:

1. A voice processing method, allowing a voice communication device to perform voice processing when a first user uses the voice communication device to communicate with a receiver end communication device used by a second user, the method comprising:

receiving, by the voice communication device, a transmitting voice signal from the receiver end communication device via a network;

analyzing, by the voice communication device, the transmitting voice signal to detect a frequency range of the transmitting voice signal;

receiving, by the voice communication device, an original voice signal from the first user;

processing, by the voice communication device, the original voice signal to a processed voice signal, wherein the processed voice signal is generated based on the frequency range of the transmitting voice signal; and outputting the processed voice signal from the voice communication device to the receiver end communication device.

2. The voice processing method as claimed in claim 1, wherein the step of processing the original voice signal to the processed voice signal comprises:

dividing the original voice signal into a plurality of voice segments;

determining whether each of the voice segments is a high frequency consonant segment; and performing a frequency reduction process to the high frequency consonant segment.

3. The voice processing method as claimed in claim 2, wherein the voice segment is determined as the high frequency consonant segment if the voice segment has the following characteristics:

the energy of the voice segment under 1000 Hz is smaller than 50% of the total energy of the voice segment; and the energy of the voice segment over 2000 Hz is greater than 30% of the total energy of the voice segment.

4. The voice processing method as claimed in claim 1, wherein the step of processing the original voice signal to the processed voice signal further comprises:

performing a frequency reduction process to the original voice signal according to an inflection parameter, wherein the inflection parameter reflects a hearing condition of the second user.

5. The voice processing method as claimed in claim 1, further comprising:

processing the original voice signal according to a voice communication frequency range of the voice communication device.

6. The voice processing method as claimed in claim 1, wherein the step of determining the frequency range of the transmitting voice signal further comprises:

determining whether one frequency band of the transmitting voice signal is being truncated.

7. The voice processing method as claimed in claim 1, wherein the step of determining the frequency range of the transmitting voice signal further comprises:

determining whether an energy value of one frequency of the transmitting voice signal is smaller than a specific value.

8. A non-transitory computer-readable storage medium, used in a voice communication device for implementing the method as claimed in claim 1.

9. A voice communication device, used by a first user to communicate with a receiver end communication device used by a second user, the voice communication device comprising:

an audio transmission module, used by the voice communication device for receiving a transmitting voice signal from the receiver end communication device via a network;

an analysis module, electrically connected to the audio transmission module, used by the voice communication device for analyzing the transmitting voice signal to detect a frequency range of the transmitting voice signal; and a processor, electrically connected to the analysis module, when receiving an original voice signal inputted from the first user, the processor processing the original voice signal to a processed voice signal, wherein the processed voice signal is generated based on the frequency range of the transmitting voice signal, so as to output the processed voice signal from the voice communication device to the receiver end communication device via the audio transmission module.

10. The voice communication device as claimed in claim 9, wherein the processor divides the original voice signal into a plurality of voice segments, determines whether each of the voice segments is a high frequency consonant segment, and performs a frequency reduction process to the high frequency consonant segment.

11. The voice communication device as claimed in claim 10, wherein the processor determines the voice segment as the high frequency consonant segment if the voice segment has the following characteristics:

the energy of the voice segment under 1000 Hz is smaller than 50% of the total energy of the voice segment; and the energy of the voice segment over 2000 Hz is greater than 30% of the total energy of the voice segment.

12. The voice communication device as claimed in claim 9, wherein the processor further performs a frequency reduction process to the original voice signal according to an inflection parameter, wherein the inflection parameter reflects a hearing condition of the second user.

13. The voice communication device as claimed in claim 9, wherein the processor further processes the original voice signal according to a voice communication frequency range of the voice communication device.

14. The voice communication device as claimed in claim 9, wherein the analysis module further determines whether one frequency band of the transmitting voice signal is being truncated.

15. The voice communication device as claimed in claim 9, wherein the analysis module further determines whether an energy value of one frequency of the transmitting voice signal is smaller than a specific value.

* * * * *